US007329140B2

(12) United States Patent
O'Connell et al.

(10) Patent No.: US 7,329,140 B2
(45) Date of Patent: Feb. 12, 2008

(54) FITTINGS FOR SWITCHES, SOCKETS OR THE LIKE

(76) Inventors: Ian O'Connell, 44 Flask Walk, Hampstead, London NW3 1HE (GB); Michelle Clare O'Connell, 31 Beresford Avenue, London N20 0AD (GB); Michael Ioannou, 31 Beresford Avenue, London N20 0AD (GB)

( * ) Notice: Subject to any disclaimer, the term of this patent is extended or adjusted under 35 U.S.C. 154(b) by 0 days.

(21) Appl. No.: 10/543,379

(22) PCT Filed: Jan. 27, 2004

(86) PCT No.: PCT/GB2004/000261

§ 371 (c)(1),
(2), (4) Date: Mar. 21, 2006

(87) PCT Pub. No.: WO2004/068648

PCT Pub. Date: Aug. 12, 2004

(65) Prior Publication Data

US 2006/0223359 A1 Oct. 5, 2006

(30) Foreign Application Priority Data

| | | |
|---|---|---|
| Jan. 27, 2003 | (GB) | 0302411.4 |
| Jan. 27, 2003 | (GB) | 0302412.2 |
| Jan. 28, 2003 | (GB) | 0301903.1 |
| Oct. 23, 2003 | (GB) | 0325676.5 |
| Oct. 23, 2003 | (GB) | 0325677.3 |

(51) Int. Cl.
*H01R 13/64* (2006.01)

(52) U.S. Cl. ..... 439/373

(58) Field of Classification Search ..... 439/373, 439/371

See application file for complete search history.

(56) References Cited

U.S. PATENT DOCUMENTS

| | | | | |
|---|---|---|---|---|
| 5,067,907 | A * | 11/1991 | Shotey | 439/135 |
| 5,655,924 | A * | 8/1997 | Cross et al. | 439/373 |
| 5,934,919 | A * | 8/1999 | Cross et al. | 439/136 |
| 6,056,580 | A | 5/2000 | Cross et al. | 439/369 |
| 6,699,060 | B1 * | 3/2004 | Scott | 439/373 |
| 6,769,930 | B1 * | 8/2004 | McDevitt, Jr. | 439/373 |
| 7,014,493 | B1 * | 3/2006 | Battard | 439/373 |
| 7,056,145 | B2 * | 6/2006 | Campbell et al. | 439/373 |
| 7,078,624 | B1 * | 7/2006 | Stewart | 174/66 |
| 7,097,474 | B1 * | 8/2006 | Naylor | 439/135 |
| 2002/0001990 | A1 * | 1/2002 | Ellis | 439/373 |
| 2005/0202709 | A1 * | 9/2005 | Campbell et al. | 439/373 |

FOREIGN PATENT DOCUMENTS

| | | |
|---|---|---|
| GB | 2366096 | 2/2002 |
| GB | 2366457 | 3/2002 |

* cited by examiner

*Primary Examiner*—Gary Paumen
(74) *Attorney, Agent, or Firm*—Polster, Lieder, Woodruff & Lucchesi, L.C.

(57) ABSTRACT

A protective cover (80) for a socket has an upper frame (81) that locates behind a faceplate of the socket and a cable tie member (82) with apertures (84) for passage of cable leads connected to plugs mounted in the socket. The upper frame (81) has a cover panel (83) pivotal between an open position allowing access to the plugs and a closed position concealing the plugs. The apertures (84) are provided with cable ties (85) that are inserted into slots (87) to retain the cable leads and transfer pulling forces applied to the cable leads to the frame (81) via the tie member (82).

14 Claims, 10 Drawing Sheets

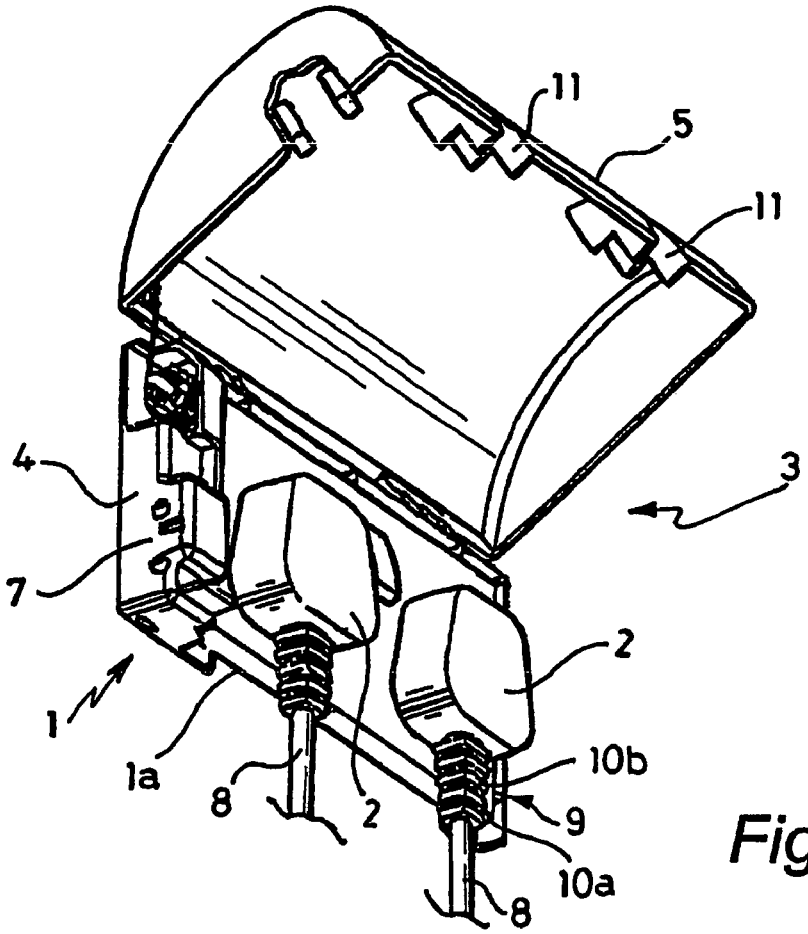
Fig. 1
Fig. 2
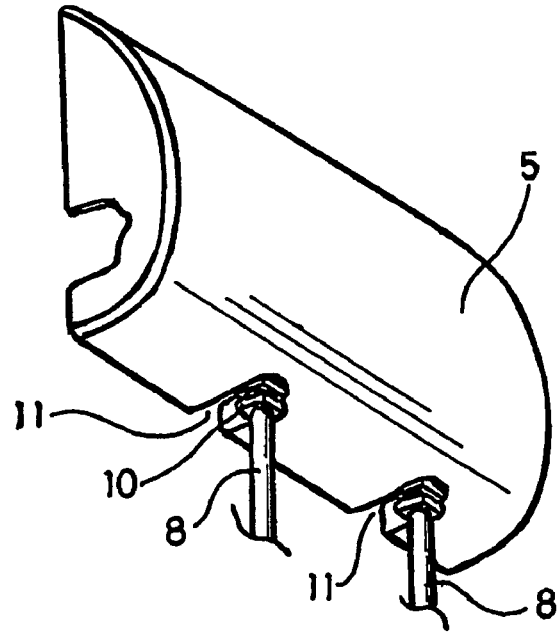

FITTINGS FOR SWITCHES, SOCKETS OR THE LIKE

RELATED APPLICATIONS

This application derives and claims priority from International Application PCT/GB2004/000261, filed Jan. 27, 2004, and published under International Publication Number WO 2004/068648 A1, and from British Applications GB0302411.4 filed Jan. 27, 2003, GB0302412.2, filed Jan. 27, 2003, GB0301903.1 filed Jan. 28, 2003, GB0325676.5 filed Oct. 23, 2003, and GB0325677.3 filed Oct. 23, 2003.

BACKGROUND OF THE INVENTION

This invention concerns improvements in or relating to fittings for switches, sockets or the like and in particular, but not exclusively, with fittings to secure, hide or restrict access to electrical or data cables trailing from a plug or jack, whilst inserted into an electrical socket or data/telephone jack-point.

The electrical or data socket may be a wall-mounted socket faceplate, conventionally secured to its mounting box by screws, or a free standing unit, such as a multi point trailing socket or a video/data/modem jack point adaptor.

In our earlier UK Patent No. 2366457-B we describe a lockable cover for a switch or socket, the cover having a cover panel movably mounted on a frame that is either mountable to the wall around, and extending behind, the switch or socket faceplate, and thus between the faceplate and the switch or socket mounting box, or permanently attached to the front of the switch or socket mounting box.

The cover panel is movable between a closed position, where it completely covers and encloses the switch or socket faceplate and any plug therein, and an open position, where it is clear from and allows access to the faceplate. The cover panel is latched in the closed position and is provided with key-operated locking means enabling the cover panel to be secured shut in the closed position.

Depending on the exact design of the frame and the cover panel, it may be desirable to provide the cover panel with an open slot for passage of the lead of a plug that allows the cover panel to be opened and closed when the plug is in place.

If desired the slot can be fitted with a sealing grommet, of rubber or some similar flexible material, to form a tight fit with the lead and so leave no significant room for a child's prying fingers or a screwdriver. With this arrangement, forces can be applied to the plug by pulling the cable and it may be possible to disconnect the plug or in extreme cases to break the cable which is undesirable.

The present invention seeks to provide an arrangement for securing the lead to inhibit disconnecting the plug by pulling the lead.

According to one aspect of the present invention, there is provided a cover panel movably mounted upon a frame for shrouding a socket and a plug therein, in which the cover panel and/or frame is arranged to define a cable slot through which a cable lead of a plug in the socket may extend, the cable slot being arranged to grip the protruding cable lead in such a way that it provides a significant degree of resistance against a pulling force applied to the cable lead externally of the cover panel.

By gripping the cable lead, should an attempt be made to remove the plug and cable either by pulling or wrenching at the cable lead in a forceful manner, the plug and cable are protected from being disconnected.

Preferably, the slot is defined by the frame. In this way, the cable tie transfers pulling forces applied to the cable to the frame which is better able to withstand the forces. In this way, the application of forces to the cover panel which could result in forcing of the latch/lock mechanism used to secure the cover panel closed can be avoided.

The cable lead can be gripped in a number of different ways. The cover panel may be mounted for pivotal or sliding movement between the open and closed positions.

One particular method is to arrange the slot to allow directional movement of the cable lead passing through the slot towards the socket, but resist any backward movement of the cable lead out of or away from the socket and cover panel. For example, a series of resilient flaps may be provided around the cable slot to form an inverted cone pointing inwardly towards the underside of the cover and the base of the plug from which the cable emerges. The angle, shape and construction of the flaps may be chosen to allow the flaps to bend and yield sufficiently as desired for passage of the cable lead towards the socket while resisting return movement. For example, the flaps may be of triangular shape.

Another method employs cable ties that are either mounted on the frame, or are an integral part of the frame, in a location that allows the cable lead from any plug attached to the socket to be securely fastened within the confines of the cover panel. For example, the cable tie may be fastened to grip and anchor the cable lead to resist the plug being pulled out of the socket by pulling the cable lead. Typically, for UK electrical sockets, the cable tie will be secured to the lower perimeter wall of the frame.

In one arrangement, the cable tie may comprise a flexible strap capable of being fastened around the cable to hold the cable. The strap may be integral with the frame. Alternatively, the strap may be separate from the frame and connected thereto during manufacture and/or during installation of the cover. The strap may be adjustable to accommodate different cable sizes. For example, the user may cut an integral strap to the required length for a given cable size. Alternatively, where the strap is separate, a set of straps of different length may be provided for selection and fitment of the appropriate strap for a given cable size.

In another arrangement, the cable tie may comprise a U-shaped clip releasably connectable to the frame. The clip is preferably arranged to resist removal from the frame under loads applied to the cable. The frame may have a bracket provided with apertures to receive and retain legs of the clip. The clip may be adjustable to accommodate different cable sizes.

In some embodiments the cable aperture is provided in the cover panel for passage of the cable lead held by the clip, and the cover panel preferably conceals the clip in the closed position. In another embodiment, the cable aperture is provided in the frame, and the cover panel preferably prevents removal of the cable tie in the closed position.

The frame may comprise a U-shaped member that extends on three sides of the socket and a cable tie member that extends on a fourth side of the socket between free ends of legs of the U-shaped member, and the cable tie is connected to the cable tie member. For example, the frame may be secured at a peripheral edge of a faceplate of the socket to which the cover is attached.

The socket may be adapted to receive at least one cable connector such as an electrical plug or a jack plug whereby the socket may provide an electrical connection point or a data/telephone/computer connection point.

According to another aspect of the present invention, there is provided a safety cover for a plug and socket connector, the safety cover having at least one aperture for a cable lead and a cable tie to hold the cable lead and inhibit disconnection of the connector by force applied to the cable lead externally of the cover.

According to a further aspect of the present invention there is provided a safety cover for a plug and socket connector, the safety cover having a frame with at least one aperture for passage of a cable lead and a cable tie to locate the cable lead such that forces applied to the cable are transferred to the frame.

According to yet another aspect of the present invention, there is provided a method of protecting a plug and socket connection comprising the steps of a) providing a cover to conceal the connection in a closed position of a movable cover panel, the cover panel being movable to an open position allowing access to the connection, b) providing the cover with a cable aperture for passage of a cable lead in the closed position of the cover panel, and c) providing the cover with a cable tie to inhibit transmission of forces applied to the cable lead to the connection.

The invention in its various aspects may be applied to an integral socket/cover where the frame is an integral part of the socket and box, or to a cover which may be subsequently mounted by inserting a frame behind the faceplate of the socket.

DESCRIPTION OF THE DRAWINGS

Exemplary embodiments of the invention are now described in more detail with reference to the accompanying diagrammatic drawings in which:

FIG. 1 is a perspective view of a cable cover according to a first embodiment of the invention fitted to a double socket with the cover panel shown in the open position;

FIG. 2 is a perspective view of the cover panel of FIG. 1 in the closed position with cable ties secured in openings in the cover panel;

DETAILED DESCRIPTION

Figure 3:
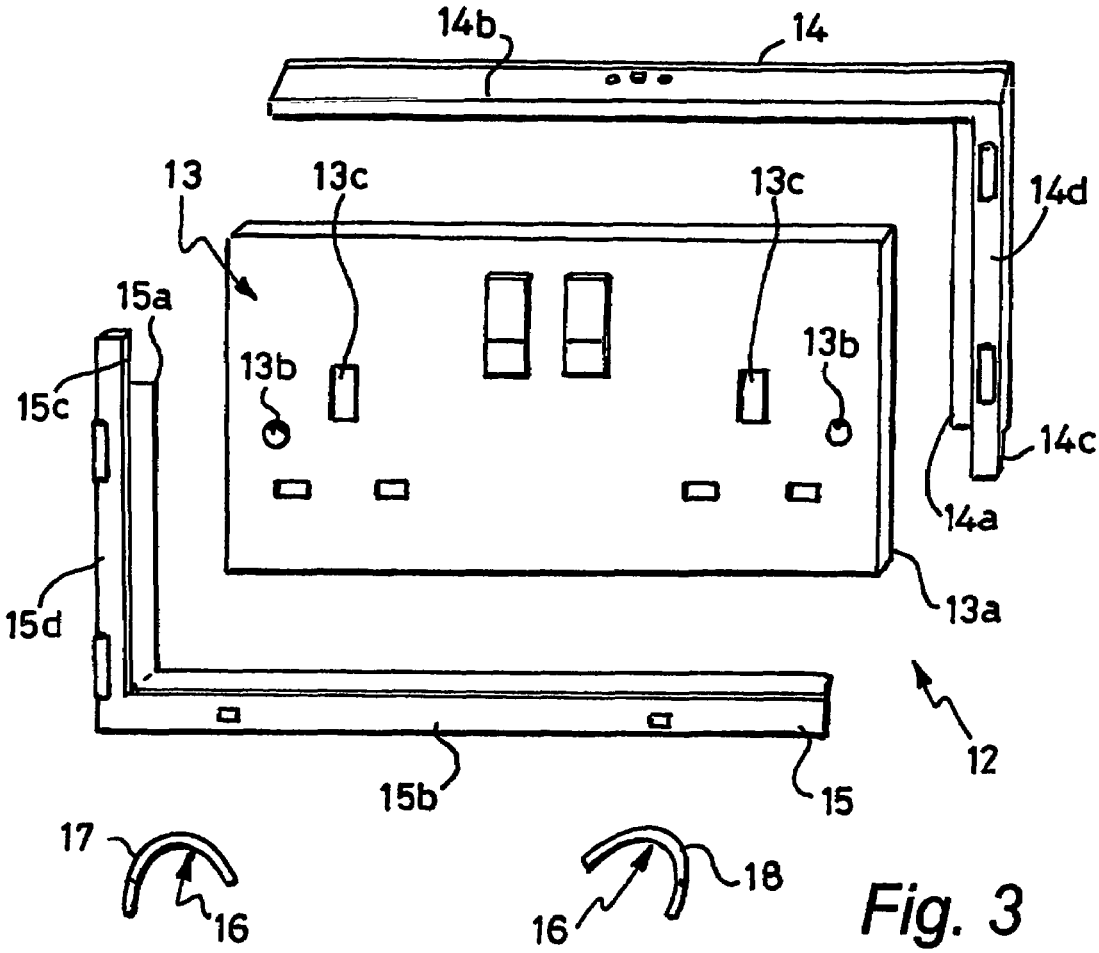
FIG. 3 is an exploded perspective view showing a frame with cable ties for a cable cover according to a second embodiment of a cable and a double socket.

Referring first to FIGS. 1 and 2 of the drawings, a wall mounted double socket 1 is shown with plugs 2 inserted in each socket 1. The socket 1 is provided with a lockable cover 3 comprising a frame 4 and a cover panel 5.

The frame 4 extends on three sides of the socket faceplate 1*a* and is secured between the socket faceplate 1*a* and the socket mounting box (not shown) to which the socket 1 is releasably secured, for example by screws (not shown).

The cover panel 5 is hinged to the frame 4 for pivotal movement about a horizontal axis at the top of the socket faceplate 1*a* between the open position shown in FIG. 1 and the closed position shown in FIG. 2.

In the open position, the plugs 2 can be inserted in and removed from pin receiving apertures (not shown) the socket faceplate 1*a*. In the closed position, the cover panel 5 conceals the plugs 2 and is secured by fastening means 7.

The fastening means 7 may be of any suitable type, for example a latch that engages automatically when the cover panel 5 is closed and which is released by means of a key (not shown) to inhibit unauthorised release of the cover panel 5.

The cover panel 5 may be lockable in the closed position for added security. The same key may lock and unlock the cover panel 5 and release the latch to allow the cover panel 5 to be moved to the open position.

In this embodiment the frame 4 and cover panel 5 are made of plastics but other materials may be used for one or both parts. The cover panel 5 is opaque but may be transparent or translucent or have a transparent or translucent window so that the user can see any plug(s) 2 inserted in the socket 1 and, where the socket 1 is provided with switches, if the switches are on or off with the cover panel 5 secured in the closed position.

In this embodiment, each plug 2 is provided with a cable lead 8 having an integral cable tie 9 in the form of a block 10 having alternate ribs 10*a* and recesses 10*b*.

The cover panel 5 is provided with a pair of U-shaped openings 11 in which the cable ties 9 are received in the closed position such that the marginal edge of each opening 11 is received in an aligned recess 10*b* of the associated cable tie 9 (see FIG. 2). In this way, the cover panel 5 grips the cable ties 9 to anchor the cable leads 8 and prevent the plugs 2 being disconnected by pulling the cable leads 8.

With this arrangement, forces or loads applied by pulling the cable leads 8 are applied to the cover panel 5 and the strength and robustness of the cable tie system depends on the materials and construction of the cover panel 5 and the fastening means 7 used to secure the cover panel 5 to the frame 4.

Figure 4:
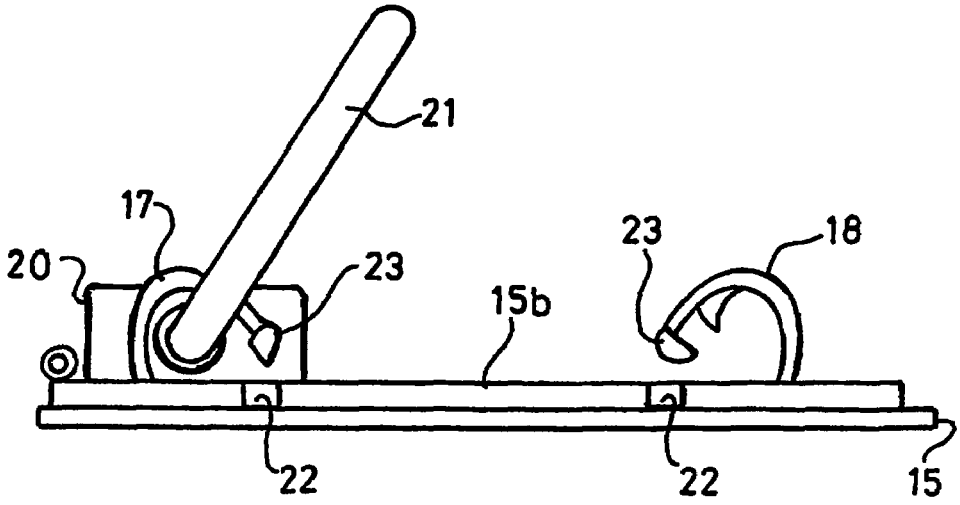
FIG. 4 is an underneath plan view showing a plug secured in the socket and the cable tie unsecured.

Referring now to FIGS. 3 and 4, there is shown a frame 12 for a lockable cover for a wall mounted double socket 13. The frame 12 comprises two L-shaped frame members 14,15.

The frame 12 is formed by assembly of the frame members 14,15 to extend on four sides of the socket faceplate 13*a* and is secured by locating flanges 14*a*,15*a* between the socket faceplate 13*a* and the socket mounting box (not shown) to which the socket 13 is secured by screws (not shown) extending through holes 13*b*.

The ends 14*c*,15*c* of vertical arms 14*d*,15*d* of the frame members 14,15 locate against the ends of the horizontal arms 15*b*,14*b* of the frame members 15,14 respectively to locate the frame members 14,15 relative to each other at opposite corners of the frame 12.

The frame member 14 has a horizontal arm 14*b* that extends along the top edge of the socket faceplate 13*a* and mounts a cover panel (not shown) for hinging movement between open and closed position as described above.

The frame member 15 has a horizontal arm 15*b* that extends along the bottom edge of the socket faceplate 13*a* and mounts a pair of cable ties 16, one for each socket, in the form of flexible straps 17,18.

Each tie 16 is secured at one end to the horizontal arm 15*b* of the frame member 15 at the base of the socket 13 and the other end is free as shown in FIG. 4. For example, the straps 17,18 may be fed through holes (not shown) in the arm 15*b* during manufacture and/or during assembly of the cover prior to the frame member 15 being slid into place behind the socket faceplate 13*a*. In a modification (not shown) the ties 16 are moulded as a permanent part of the perimeter frame 12.

The ties 16 are approximately aligned with the pin receiving apertures 13*c* in the faceplate 13*a* (in this case along a vertical axis) so that, with the cover panel in the open position, a plug 20 can be inserted in the pin receiving apertures 13*c* of the socket 13 and the trailing cable lead 21 secured below the plug 20 by the tie 16.

More particularly, the tie 16 is folded over the cable lead 21 and the free end inserted in a hole 22 in the frame member 15 to allow a toothed detent 23 to engage with a suitable retaining formation (not shown) located in the hole 22. The tie 16 may have more than one detent to allow the secured length of the strap to be adjusted to suit the size (diameter) of the cable lead 21. Alternatively or additionally, the strap may be cut to length prior to securing the cable lead 21.

The cover panel can then be closed to conceal the plug 20 and the tie 16. In this way, access to the plug 20 and tie 16 is prevented when the cover panel is closed and the tie 16 anchors the cable lead 21 to prevent the plug 20 being disconnected by pulling the cable lead 21.

The cover panel can be latched and locked in the closed position by means of key operated fastening means and/or may be opaque or transparent as described previously.

In this arrangement, the load of any force or pressure applied to the cable lead is transferred away from the cover panel and fastening means onto the frame 12 by means of the cable tie 16.

The frame 12 can be of robust construction and is secured in most cases by at least two metal screws securely tightened to the socket mounting box. As a result, the frame 12 can better withstand the effects of force than the fastening mechanism employed to secure the cover panel in the closed position.

The ties 16 are manufactured from a material with properties that allow the ties 16 to flex or bend, yet faithfully retain memory of its original shape and position despite repeated movement or flexing.

In this way, the ties 16 are flexible enough to withstand being manually deformed outwards (that is, to straighten sufficiently) to allow the cable lead 21 to be inserted underneath so that the tie 16 encloses the cable lead 21.

Moreover, the ties 16 are flexible enough to be manually deformed inwards (that is, to be curled towards the frame member 15 sufficiently) to grip and anchor the cable lead 21.

Suitable materials for the ties 16 include steel or aluminium, but preferably polymers such as acetal (polyoxymethylene) and/or other thermoplastics such as Delrin (formed by polymerising formaldehyde and acetate) or Celcon (formed by polymerising trioxene and cyclic) are used. These polymers may be prepared in varying degrees of rigidity, according to the application.

For example, if the ties 16 are integral to the frame member 15, then they will be of a harder material in order for the frame member 15 to have sufficient strength. Alternatively, if the ties 16 are formed separately as shown in FIG. 3, then they may be made as flexible as is necessary, and the frame member 15 can be rendered from an entirely different material.

Figure 5:
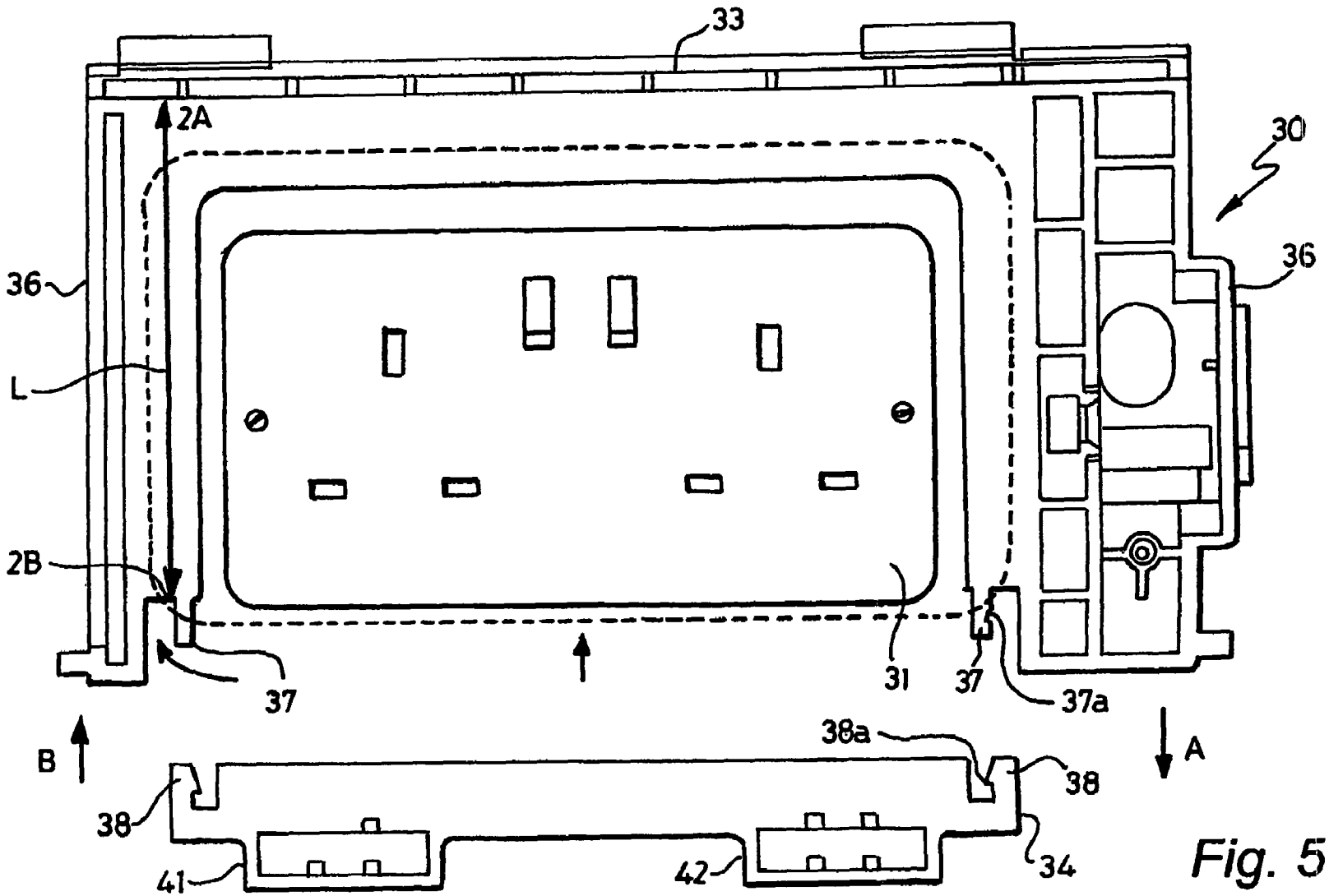
FIG. 5 is a rear view showing a frame with detachable cable tie bar for a cable cover according to a third embodiment of the invention and a double socket with the edge of the socket faceplate shown in outline.
Figure 6:
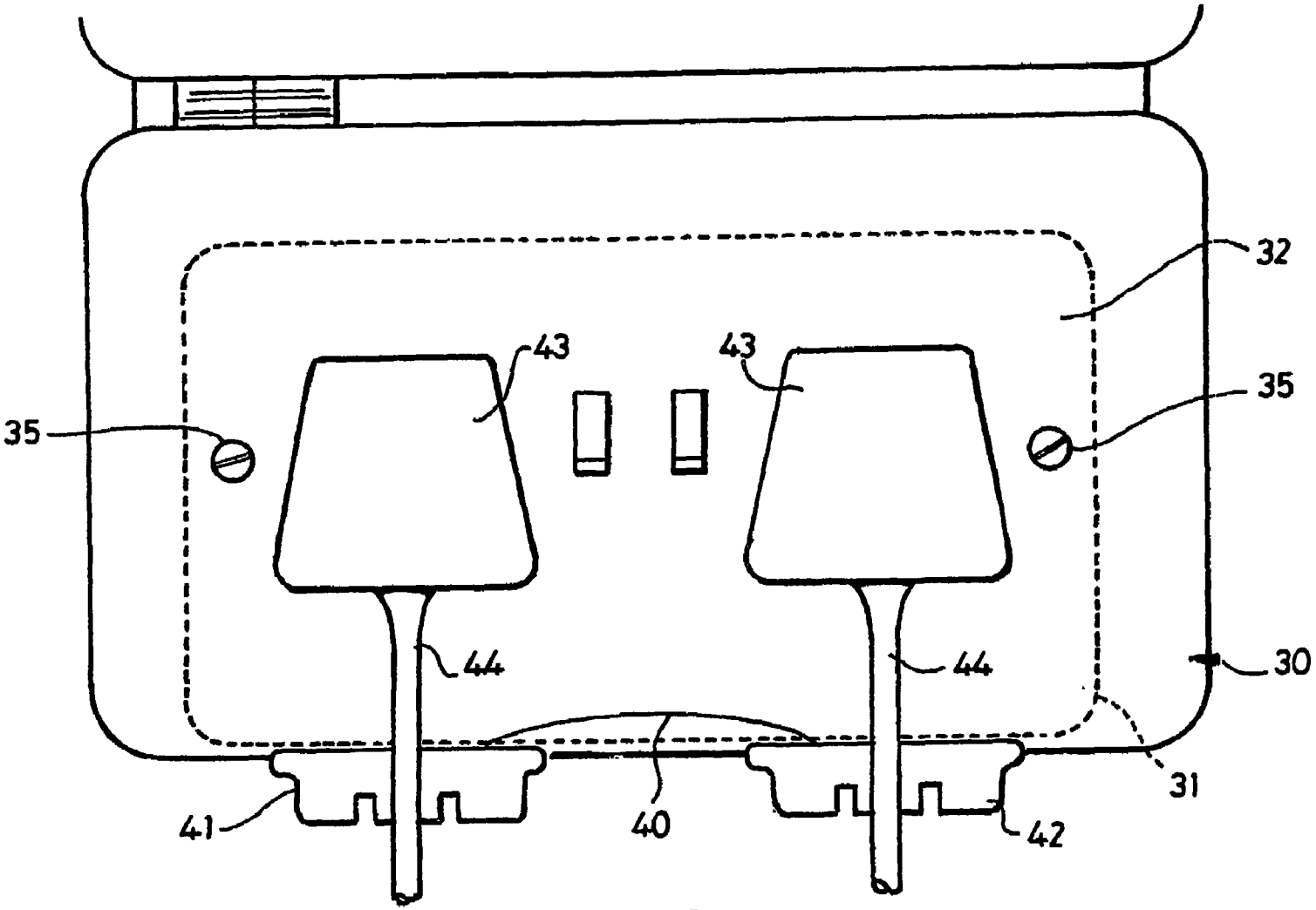
FIG. 6 is a front view showing the frame of FIG. 5 assembled and fitted to the double socket with plugs inserted in the socket and cable leads extending through the cable tie bar.
Figure 7A:
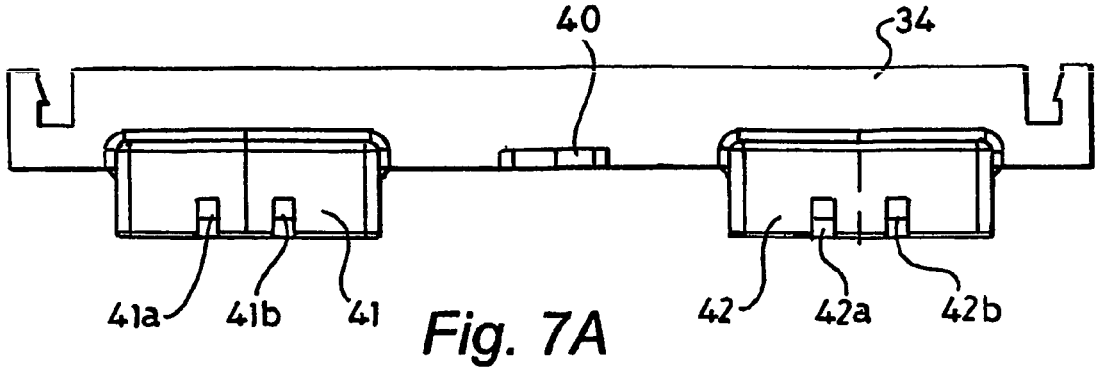
FIG. 7*a*-7*c* are front, top and bottom views of the cable tie shown in FIGS. 5 and 6.
Figure 7B:
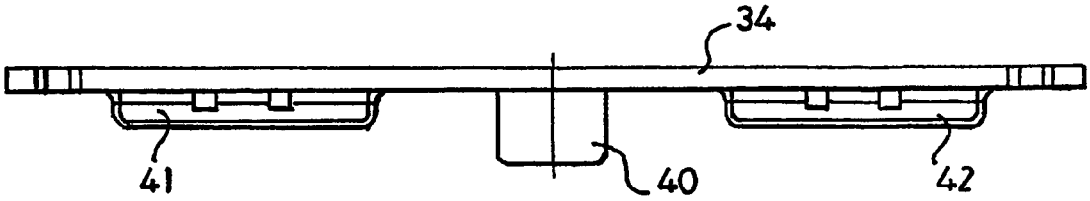
Figure 7C:
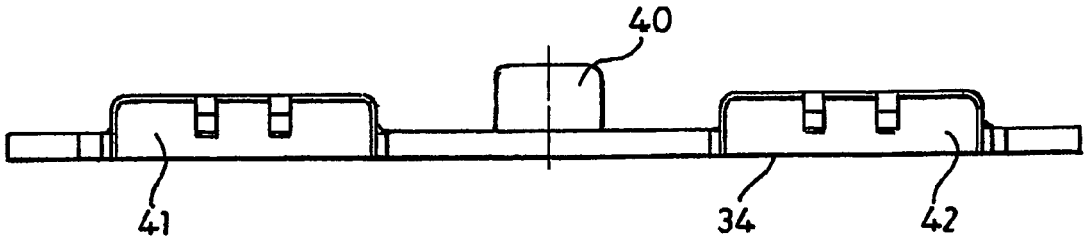
Figure 8A:
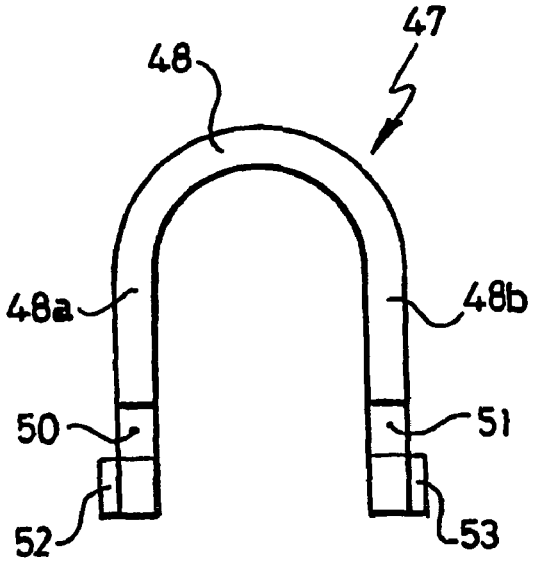
FIGS. 8*a*-8*d* are views of a cable tie for use with the cable tie bar shown in FIGS. 5 and 6.
Figure 8B:
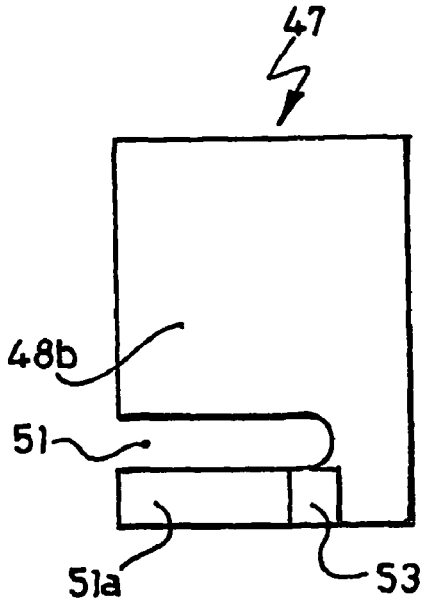
Figure 8C:
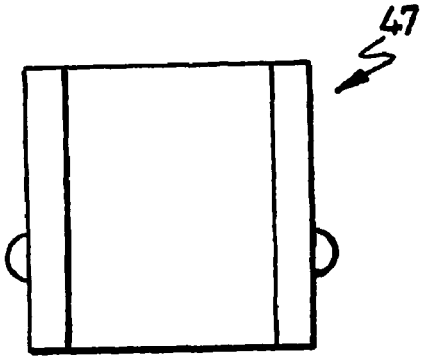
Figure 8D:
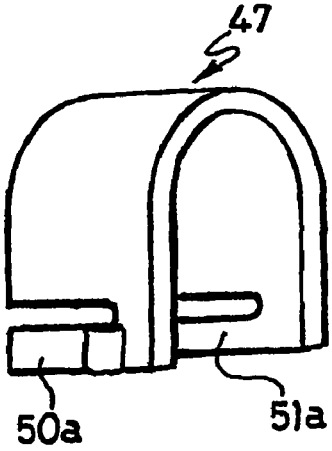
Figure 9:
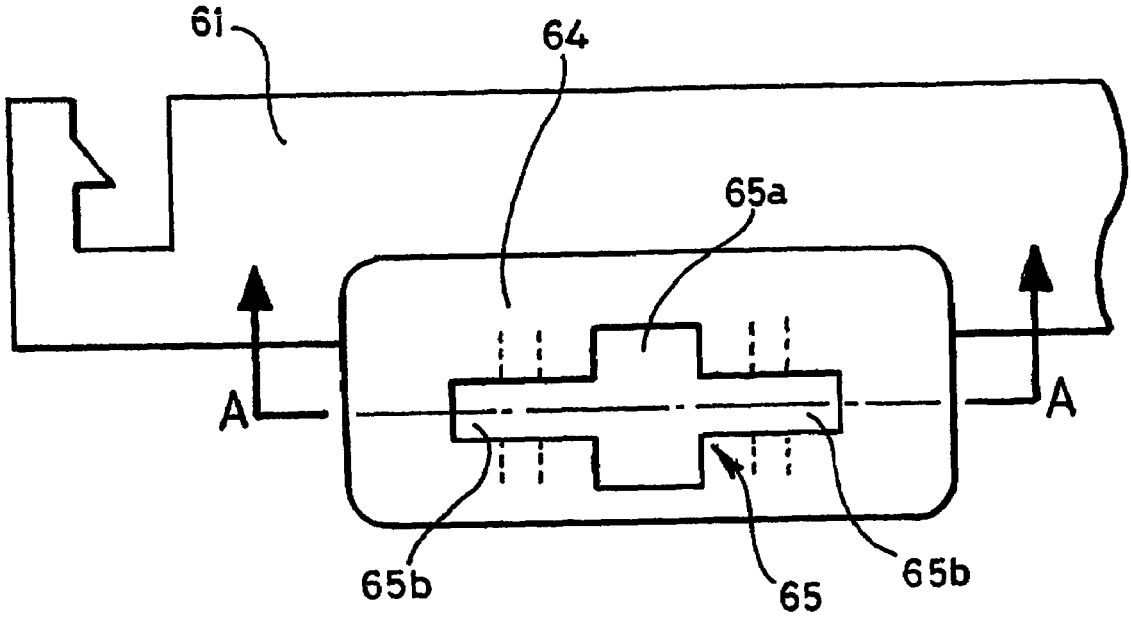
FIG. 9 shows a modification to the cable tie bar of FIGS. 5 and 6.
Figure 10:
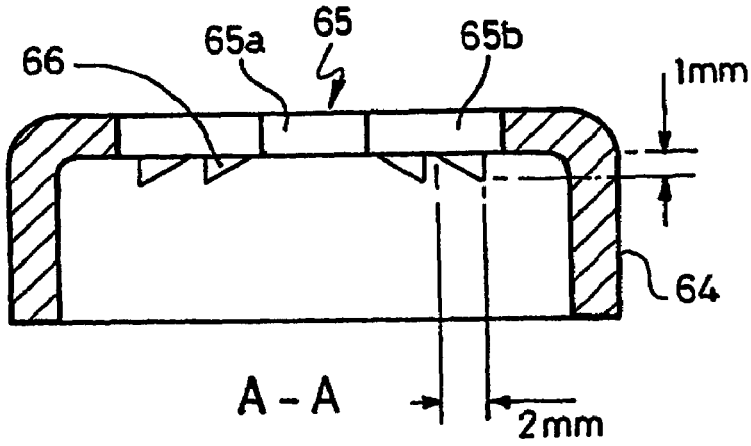
FIG. 10 is a section on the line A-A of FIG. 9.
Figure 11:
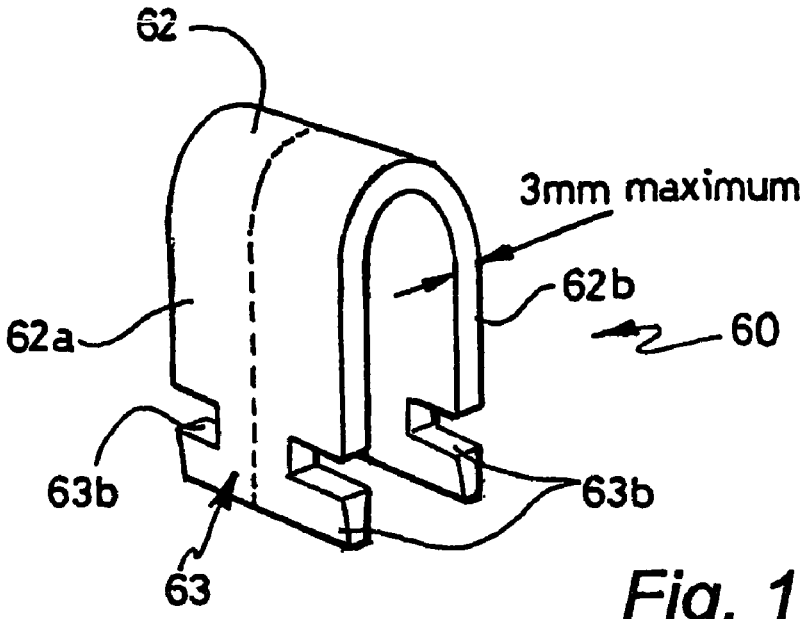
FIG. 11 shows a cable tie for use with the cable tie bar of FIGS. 9 and 10.

Referring now to FIGS. 5 to 7, there is shown a frame 30 for a lockable, detachable cover for a double socket 31. The frame 30 and socket 31 are shown from the rear in FIG. 5 and the peripheral edge of a faceplate 32 of the socket 31 is shown in dotted outline.

As shown, the frame 30 comprises a three-sided frame member 33 and a cable tie member 34. The three-sided frame member 33 is slidable behind the faceplate 32 and the faceplate 32 is secured to a wall mounting box (not shown) by means of threaded screws 35 (see FIG. 6).

The length L of legs 36 of the frame member 33 between the points 2A and 2B is such that the frame member 33 can be slid behind the faceplate 32 to position the free ends of the legs 36 below the lower edge of the faceplate 32.

The free ends of the legs 36 are provided with clips 37 located at the lower inside corner of each leg 36. The cable tie member 34 is provided with mating clips 38 that are engageable with the clips 37 to connect the cable tie member 34 to the frame member 33. In this way, the frame 30 is four sided, enclosing the perimeter of the faceplate 32.

The clips 37,38 have interlocking formations 37*a*,38*a* that engage to prevent movement of the cable tie member 34 in the direction of arrow A relative to the frame member 33. The clips 37,38 may engage with a snap action in the direction of arrow B or by push fit in a direction normal thereto (in the manner of interfitting jigsaw pieces).

The assembled frame 30 can then be slid upwards behind the faceplate 32 until the clips 37,38 are fully covered by the faceplate 32. The faceplate 32 can then be secured by tightening the screws 35 to locate and retain the frame 30 in position as shown in FIG. 6—in effect sandwiched between the mounting box and the underside of the faceplate 32

The cable tie member 34 has a guide to ensure its correct positioning in relation to the socket faceplate 32. This is achieved by manoeuvring the entire frame 30 in situ so that an upper ledge 40 of the cable tie member 34 comes to rest flush and parallel to the lower edge of the socket faceplate 32.

The cable tie member 34 is provided with a pair of cable tie brackets 41,42 that are located approximately in line (in this case along the vertical axis) with the pin receiving apertures of the faceplate 32 so that, when a plug 43 is inserted in the pin receiving apertures in the faceplate 32 of the socket 31, the trailing cable lead 44 extends over the aligned bracket 41,42.

Each bracket 41,42 is provided with a detachable cable tie 47 (see FIGS. 8A-8D) to secure the trailing cable lead 44. The cable tie 47 is in the form of a U-shaped or arch shaped clip 48 having two legs 48*a*,*b* and is made from a material that offers a degree of flexing of the legs 48*a,b* to enable a strong fastening to be achieved.

The legs 48*a,b* are provided with transverse slots 50,51 parallel to and spaced from the free ends that define feet 50*a*,51*a*. The brackets 41,42 are provided with matchingly shaped apertures 41*a,b* and 42*a,b* to receive the feet 50*a*, 51*a*. The spacing between the apertures 41*a,b* or 42*a,b* is slightly less than the spacing between the legs 48*a,b* in their relaxed condition.

When a plug 43, is inserted into the socket 31, the trailing cable lead 44 can be secured to the cable tie member 34 by holding the cable in place against the aligned bracket 41,42 and then inserting the feet 50*a*,51*a* of the clip 48 into the apertures 41*a,b* or 42*a,b*.

More particularly, the body of the clip 48 is pinched together slightly to fit the 50*a*.51*a* to the precise width that the apertures 41*a,b* or 42*a,b* are set apart so that they can be inserted into their apertures 41*a,b* or 42*a,b*. This causes the feet 50*a*,51*a* to be biased inwards under a degree of sprung tension when located inside the apertures 41*a,b* or 42*a,b*

The legs 48*a,b* have one or more latches 52,53 moulded onto their outer edges at the free end which, when the feet 50*a*,51*a* are inserted into the apertures 41*a,b* or 42*a,b* locate in matchingly shaped recesses (not shown) hollowed out of each inside wall of the apertures 41*a,b* or 42*a,b* to secure and retain the cable ties 47 in position.

More specifically, as the latches 52,53 align with the recesses, so the legs 48*a,b* are caused to spring outwards slightly by a distance corresponding to the depth of the latch 52,53 and its recess, so that the outside walls of the legs 48*a,b* flush against the inside walls of the apertures 41*a,b* or 42*a,b*. The spring tension causes the latches 52,53 to be held located in the recesses preventing the feet 50*a*,51*a* from moving backwards out of the apertures 41*ab* or 42*a,b*.

The latches 52,53 provide resistance to any lateral movement of the feet 50*a*,51*a* even when force is applied against the cable lead 44 thus preventing the cable tie 47 from falling out of the bracket 41,42.

In this embodiment, the cable tie 47 has 2 mm wide legs 48*a,b* set at a distance of 10 mm apart from each other, and each latch 52,53 is 0.8 mm in depth, to give a total breadth for each leg (including the latch extrusions) of 2.8 mm, and a total width of 15.6 mm.

This particular cable tie 47 is designed for apertures 41*a,b* or 42*a,b* that are 2.9 mm wide and are spaced 7.3 mm apart. Thus the material used in the manufacture of the cable tie 47 should allow the legs 48*a,b* to be pinched together by at least 2.5 mm, and have a memory to return to their regular width of 15.6 mm once removed. It will be understood that these dimensions are exemplary only and the invention is not limited thereto.

The cover panel (not shown) is hinged to the frame member 30 for pivotal movement about a horizontal axis at the top of the socket faceplate 32 between an open position allowing access to plugs 44 and associated cable ties 47 and a closed position concealing the plugs 44 and cable ties 47. The cover may be latched and locked in the closed position to inhibit unauthorised opening as described previously.

The cover panel is provided with cable exit apertures that are located, shaped and sized so that, when the cover panel is closed with the cable tie 47 correctly in place within the associated bracket 41,42, the exit apertures locate over the cable tie 47 and associated bracket so that the cable tie 47 cannot be removed whilst the cover is closed.

To remove the cable tie 47 from the associated bracket 41,42, the cover panel is unlocked and released from its retaining latches and pivoted to its open position allowing access to the cable tie 47. The body of the cable tie 47 is pinched together slightly so that the leg latches 52,53 can be released from their corresponding recesses and allow the cable tie 47 to be withdrawn.

Although the cable tie 47 described above is adequate for most kinds of electrical and data cables, there are occasions when it is desirable to use a cable tie that is adjustable within its bracket 41,42 so that it may conveniently be used upon cables of varying shape and thickness. This is particularly the case when a user employs appliances such as power tools, or other such appliances that are supplied with plugs and cables shrouded with a thick rubber moulding.

FIGS. 9 to 12 show a modified cable tie 60 and cable tie bar 61 that allows manual adjustment of the tie 60 while remaining capable of shrouding and securing cables of varying diameters and shapes. The principle of enclosing or shrouding the cable is the same as described above.

As shown, the cable tie 60 comprises a U-shaped clip 62 with two legs 62*a,b* having T-shaped elements 63 at the free ends, and the tie bar 61 has a bracket 64 with an aperture 65 shaped like a cross located on the front face of the bracket 64.

The body of the cable tie 60 is again pinched to bring the legs 62*a,b* together such that a wider part 63*b* of the elements 63 can be inserted into a wider central part 65*a* of the aperture 65 to align a narrower part 63*b* of the elements 63 with narrower end parts 65*b* of the aperture 65. The legs 62*a,b* spring outwards along the narrower part 65*b* away from the wider central part 65*a* to locate and retain the legs in the aperture 65.

The bracket has notched latches 66 moulded on the underside of the aperture 65 along the narrower part 65*b*. These latches 66 are shaped to allow the elements 63 to move along the narrower part 65*b* of the aperture 65 away from the wider centre part 65*a* and inhibit return movement.

The further away the elements 63 are located from the central part 65*a* of the aperture 65, the wider and flatter the arch of the cable tie 60 will be upon the bracket 61. This movement provides adjustment that enables the cable tie 60 to fit around cables of varying thickness and shape.

Figure 12:
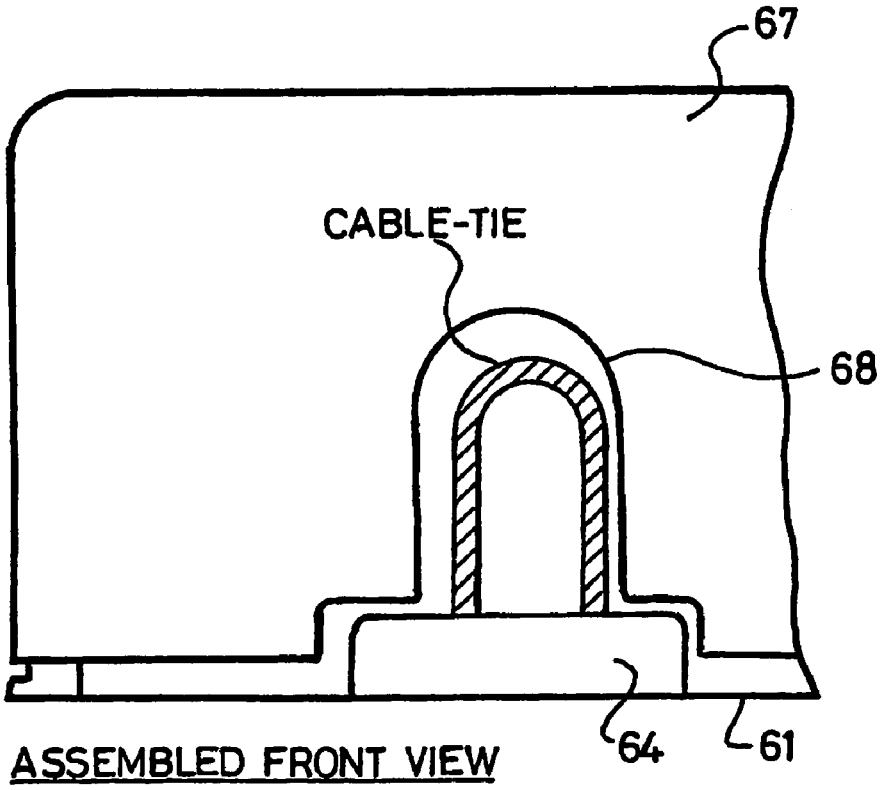
FIG. 12 shows the cable tie connected to the tie bar and the cover panel closed.

As best shown in FIG. 12, the cover panel 67 is provided with an aperture 68 that aligns with the cable tie 60 in the closed position for passage of the trailing cable lead out of the cover. The cover panel 67 prevents access to release the cable tie 60 in the closed position.

In this way, any upward force applied to the cable (such as when force is applied to try and dislodge the plug from its faceplate) is transferred to the cable tie 60 whereupon the latches 66 prevent movement of the legs 62*a,b* back towards the central part 65*a* of the aperture 65. As a result, the cable tie 60 is held in place and the loads are transferred to the frame via the cable tie member 61. In other respects the arrangement is similar to FIGS. 5 to 8 and will be understood from the description of those Figures.

Figure 13:
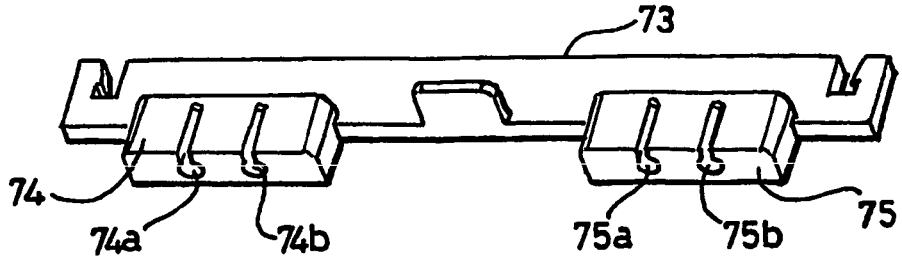
FIG. 13 shows another modification to the cable tie bar of FIGS. 5 and 6.
Figure 14A:
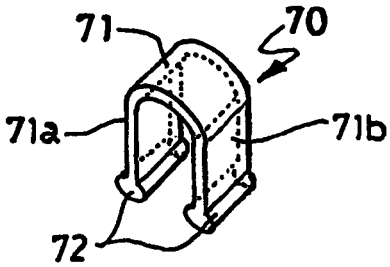
FIGS. 14*a*-*b* are views of a cable tie for use with the cable tie bar of FIG. 13.
Figure 14B:
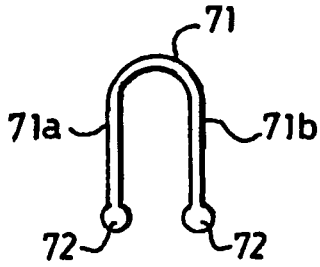

Referring now to FIGS. 13 and 14*a,b*, there is shown a modification to the cable tie bar and cable tie shown in FIGS. 5 to 8. In this embodiment, the cable tie 70 comprises a U-shaped clip 71 and the legs 71*a,b* of the clip 71 are provided with annular beads 72 at the outer, free ends.

The cable tie member 73 has brackets 74,75 provided with slots 74*a,b* and 75*a,b* to receive the beads 72 to secure the clips 72 and hold the trailing cable leads of plugs (not shown) inserted in a socket (not shown) to which a cover with cover panel and frame as described above is fitted.

In this embodiment, the slots 74*a,b* and 75*a,b* are of cylindrical shape and the beads 72 are of conical shape tapering from one end to the other or vice versa. The narrower end is inserted into the aligned slot and the wider end is an interference fit in the slot to retain the bead in place and secure the cable ties 73 to the brackets 74,75. This provides a strong, robust construction able to transfer effectively pulling forces applied to a cable to the frame via the tie bar.

The cover panel prevents access to the cable ties 70 in the closed position and the cable ties 70 transfer loads applied to the trailing cable leads to the frame via the cable tie member 71 to prevent the plugs being pulled out of the socket. In other respects the arrangement is similar to FIGS. 5 to 8 and will be understood from the description of those Figures.

Figure 15:
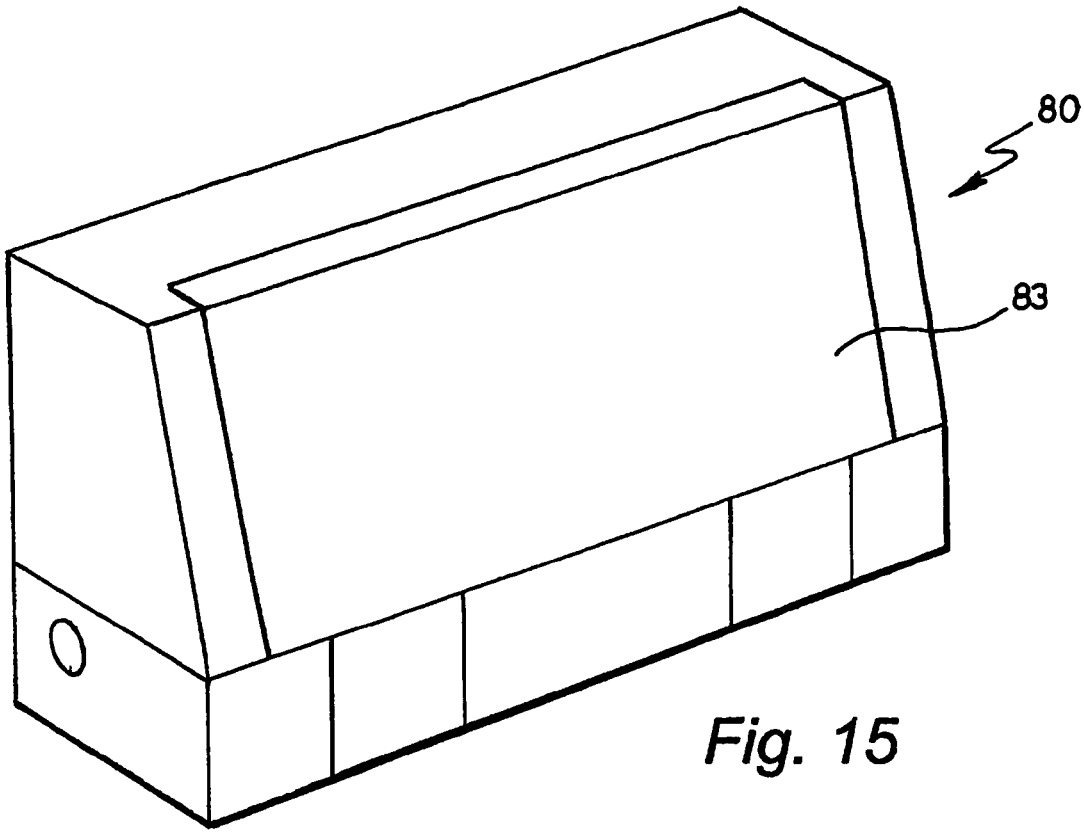
FIG. 15 is a perspective front view of a cable cover according to a fourth embodiment of the invention with the cover panel shown in the closed position.
Figure 16:
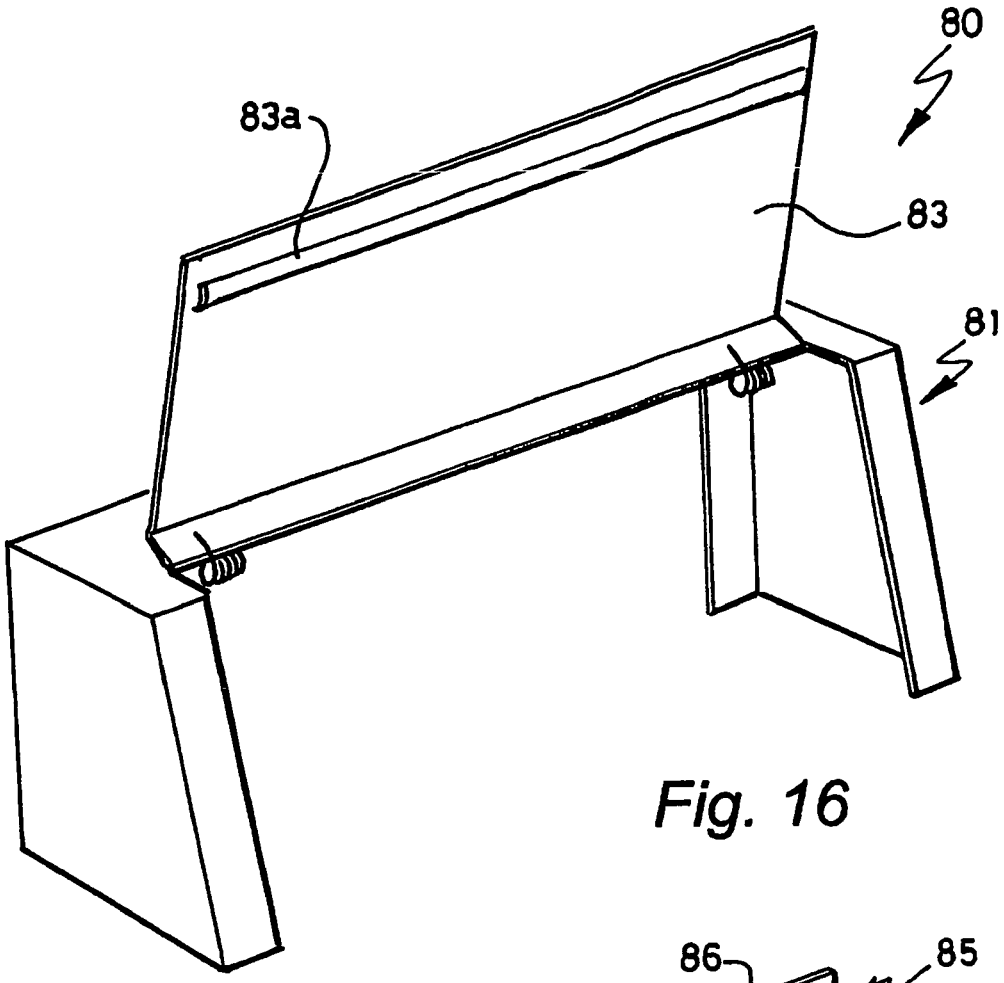
FIG. 16 shows the cable cover panel of FIG. 15 in the open position.
Figure 17:
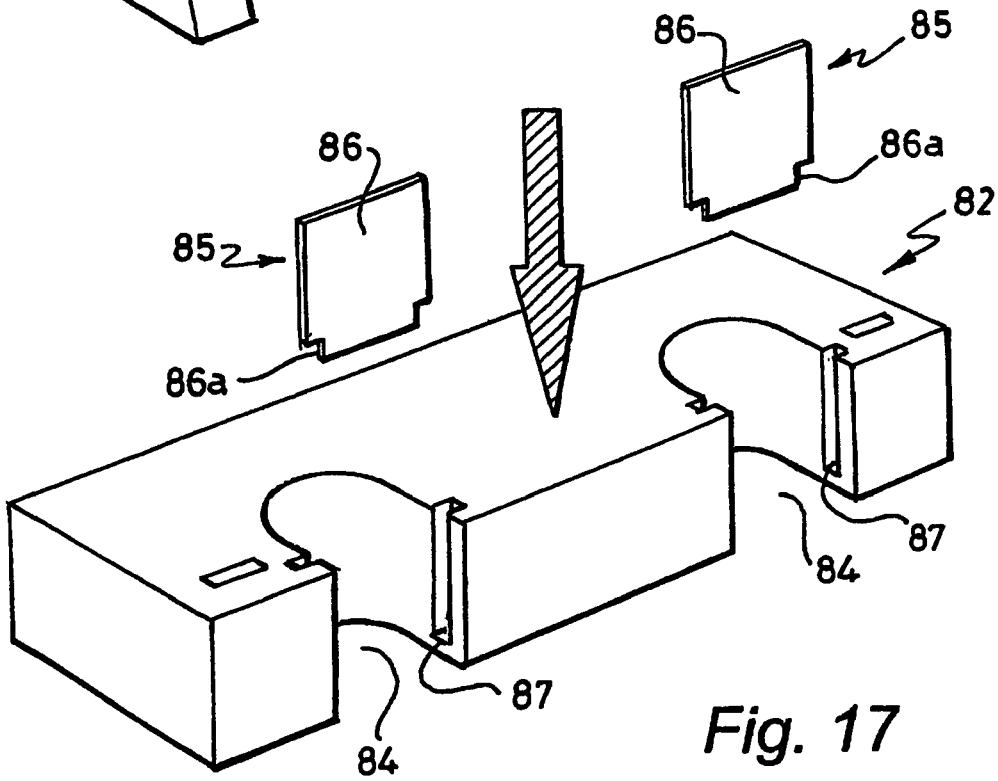
FIG. 17 is an exploded perspective view of cable tie bar and cable ties of the cable cover shown in FIG. 15.

Referring now to FIGS. 15 to 17, there is shown a lockable cover 80 with an upper cover frame 81 and a lower, cable tie member 82. The cover frame 81 is provided with a cover panel 83 movable between a closed position (FIG. 15) and an open position (FIG. 16).

The cable tie member 82 is provided with two cable aperture points in the form of U-shaped recesses 84 through which trailing leads of plugs (not shown) inserted in a socket (not shown) to which the cover 80 is secured can pass. The recesses 84 are provided with cable ties 85 in the form of flat plates 86 with indents 86*a*.

In use, the trailing leads of plugs are seated in the recesses and the plates 86 slid into slots 87 at the front of the recesses to retain the cable in the recess 84. When the cover panel 83 is closed and locked, the lower edge of the cover panel locates on top of and along the front edge of the cable tie member 82.

A rib 83*a* on the rear face of the cover panel 83 prevents the cable ties 85 being moved upwards and the slots 87 prevent the cable ties being moved forcibly outwards (forwards). As a result, the cable ties 85 are held in place and transfer any loads applied to the trailing cable leads to the frame via the cable tie member 82 to prevent the plugs being pulled out of the socket when the cover panel 83 is closed.

The cable ties 85 can be released once the cover panel 83 is moved to its open position. The cover panel 83 can be latched and locked in the closed position for security by any suitable key operated fastening means as described previously.

The cable ties described herein can be designed and manufactured to incorporate a sheath or shroud for the cable, as an all in one piece. The cable tie shroud (not pictured) could extend just a few centimetres, or enclose a cable of many meters, as far as the connection cable entry point to the appliance the plug is providing power to.

The cable tie shroud could be tailored by a factory or manually cut to size by the consumer. The material used for the shroud if manufactured as a one piece—would be much like the material used in the manufacture of garden hoses. The shroud could have a slit extending along it length for inserting a cable being held in place by the cable tie so as to be fully enclosed. The cable tie shroud could serve the many established purposes of a cable tidy; safety, neatness, organisation (e.g. cable trunking) security or even decor.

As will be appreciated, the cable ties described herein hold the cable lead in place and resist the application of effort or force to disconnect the plug by pulling the cable lead. The effectiveness of the cable tie is governed by the strength and robustness of the material the cable tie is manufactured from and the security of its fitting.

Other arrangements will be apparent to those skilled in the art and the invention is deemed to include all variations and modifications within the scope of the claims.

Although the invention has been described in connection with a cover for a wall mounted double socket, it will be understood that the invention is not limited to such arrangements and may be employed with single or multiple wall mounted sockets as well as free standing sockets, such as a multi point trailing socket or a video/data/modem jack point adaptor. For wall mounted sockets, the frame may located behind the faceplate and secured by the screws used to fasten the faceplate to the mounting box. Alternatively, the frame may be an integral part of the faceplate, for example the frame and faceplate may be either formed integrally such as by moulding or formed separately and permanently connected together such as by bonding or by non-releasable fasteners. It will also be understood that the invention covers any arrangement in which a plug and socket connector with cable lead is to be protected from attempts to disconnect the connector by pulling the cable lead and the terms plug and socket are to be construed accordingly.

What is claimed is:

1. A socket protection system comprising a cover panel movably mounted upon a frame for shrouding a socket and a plug therein, in which said cover panel and/or frame is arranged to define a cable aperture through which a cable lead of a plug in said socket may extend, said cable aperture being arranged to locate the protruding cable lead in such a way that it provides a significant degree of resistance against a pulling force applied to the cable lead externally of said cover panel; and wherein a cable tie is provided for locating the cable lead in said cable aperture.

2. A socket protection system according to claim 1 wherein said cable tie is an integral part of the cable lead and said cable aperture is formed in said cover panel and arranged to engage said cable tie.

3. A socket protection system according to claim 1 wherein said cable tie is connected to said frame.

4. A socket protection system according to claim 3 wherein said cable tie comprises a flexible strap.

5. A socket protection system according to claim 4 wherein said strap is integral with said frame.

6. A socket protection system according to claim 3 wherein said cable tie comprises a U-shaped clip releasably connectable to said frame.

7. A socket protection system according to claim 6 wherein said clip is arranged to resist removal from said frame under loads applied to the cable lead.

8. A socket protection system according to claim 6 wherein said frame has a bracket provided with apertures to receive and retain legs of said clip.

9. A socket protection system according to claim 6 wherein said clip is adjustable to accommodate different cable lead sizes.

10. A socket protection system according to claim 6 wherein said cable aperture is provided in said cover panel for passage of the cable lead held by said clip.

11. A socket protection system according to claim 10 wherein said cover panel conceals said clip in the closed position to prevent unauthorized release.

12. A socket protection system according to claim 1 wherein said frame comprises a U-shaped member that extends on three sides of said socket and a cable tie member that extends on a fourth side of said socket between free ends of legs of said U-shaped member, and said cable tie is connected to said cable tie member.

13. A socket protection system according to claim 12 wherein said cable aperture is provided in said cable tie member.

14. A safety cover for a plug and a socket connector comprising a frame with at least one aperture for passable of a cable lead and a cable tie to locate the cable lead such that forces applied to the cable lead are transferred to said frame; and wherein said cover has a cover panel arranged for movement between a closed position concealing the connector and an open position allowing access to the connector, and said cover panel is releasably secured in said closed position by fastening means to restrict access to the connector.

* * * * *